US007485794B2

(12) United States Patent
Koizumi

(10) Patent No.: US 7,485,794 B2
(45) Date of Patent: Feb. 3, 2009

(54) ELECTRONIC MUSICAL INSTRUMENT SYSTEM

(75) Inventor: Tomonori Koizumi, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 139 days.

(21) Appl. No.: 11/724,877

(22) Filed: Mar. 15, 2007

(65) Prior Publication Data

US 2007/0234883 A1 Oct. 11, 2007

(30) Foreign Application Priority Data

Mar. 24, 2006 (JP) ..... 2006-082580
Mar. 24, 2006 (JP) ..... 2006-082581

(51) Int. Cl.
*G10H 1/18* (2006.01)

(52) U.S. Cl. ..... 84/601; 84/615; 84/477 R; 84/483.1

(58) Field of Classification Search ..... 84/600–602, 84/615, 622, 645, 477 R, 478, 483.1, 483.2
See application file for complete search history.

(56) References Cited

U.S. PATENT DOCUMENTS 4,884,974 A * 12/1989 DeSmet ..... 434/317
5,739,814 A * 4/1998 Ohara et al. ..... 345/173
5,878,292 A * 3/1999 Bell et al. ..... 396/312
6,164,534 A * 12/2000 Rathus et al. ..... 235/380
6,330,427 B1 * 12/2001 Tabachnik ..... 434/317
6,363,239 B1 * 3/2002 Tutt et al. ..... 434/317
6,655,586 B1 * 12/2003 Back et al. ..... 235/382
7,035,583 B2 * 4/2006 Ferrigno et al. ..... 434/308
7,290,700 B2 * 11/2007 Song ..... 235/375
7,333,768 B1 * 2/2008 Coltman et al. ..... 434/317
2003/0131716 A1 7/2003 Aoki et al.
2003/0196542 A1 * 10/2003 Harrison, Jr. ..... 84/737
2004/0193676 A1 * 9/2004 Marks ..... 709/203
2004/0229696 A1 * 11/2004 Beck ..... 463/40
2004/0267917 A1 * 12/2004 Tokkonen et al. ..... 709/223
2005/0175973 A1 * 8/2005 Miller ..... 434/317
2005/0197250 A1 * 9/2005 Kawahara et al. ..... 503/201
2005/0270964 A1 * 12/2005 Ujino ..... 369/274
2005/0278230 A1 * 12/2005 Shirasaka et al. ..... 705/26
2006/0081696 A1 * 4/2006 Sakurai et al. ..... 235/375
2006/0082818 A1 * 4/2006 Kasamatsu et al. ..... 358/1.15

(Continued)

FOREIGN PATENT DOCUMENTS

JP 2003-208163 7/2003

(Continued)

*Primary Examiner*—David S. Warren
(74) *Attorney, Agent, or Firm*—Morrison & Foerster LLP

(57) ABSTRACT

An RF tag having stored therein equipment setting information related to a performance, by an electronic musical instrument, of a given music piece is attached to a music-piece-related information having music-piece-related information of the given music piece presented thereon. Electronic musical instrument includes an information acquisition information that communicates with the RF tag to acquire the equipment setting information from the tag, and an automatic setting section that automatically sets various settings and states of the musical instrument in accordance with the acquired equipment setting information. The musical instrument may further include a trigger section that triggers the acquisition section to acquire the equipment setting information from the RF tag. When the acquisition section has acquired new equipment setting information in response to triggering by the trigger section, states of the electronic musical instrument are set in accordance with the new equipment setting information.

26 Claims, 6 Drawing Sheets

U.S. PATENT DOCUMENTS

2006/0093312 A1* 5/2006 Park et al. ..... 386/46
2006/0098901 A1* 5/2006 Hino ..... 382/306
2006/0164244 A1* 7/2006 Kiryama ..... 340/572.1
2006/0165457 A1* 7/2006 Hasagawa et al. ..... 400/62
2006/0176510 A1* 8/2006 Nishizawa ..... 358/1.15
2006/0187055 A1* 8/2006 Colby ..... 340/572.7
2006/0187060 A1* 8/2006 Colby ..... 340/572.8
2006/0237544 A1* 10/2006 Matsuura et al. ..... 235/492
2006/0254815 A1* 11/2006 Humphrey et al. ..... 174/380
2007/0000375 A1* 1/2007 Harrison, Jr. ..... 84/737
2007/0039450 A1* 2/2007 Ohshima et al. ..... 84/616
2007/0103275 A1* 5/2007 Nakano et al. ..... 340/286.07
2007/0194101 A1* 8/2007 Rathus et al. ..... 235/375
2007/0205874 A1* 9/2007 Tokkonen et al. ..... 340/10.41
2007/0243513 A1* 10/2007 Ohshima et al. ..... 434/308
2008/0071402 A1* 3/2008 Igoe ..... 700/94

FOREIGN PATENT DOCUMENTS

JP 2005243119 A * 9/2005
JP 2006317612 A * 11/2006
JP 2007256354 A * 10/2007
JP 2007310308 A * 11/2007

* cited by examiner

ELECTRONIC MUSICAL INSTRUMENT SYSTEM

BACKGROUND OF THE INVENTION

The present invention relates generally to electronic musical instruments capable of performing manual performances responsive to performance operation by human players, automatic performances based on automatic performance data, training performances, etc. More particularly, the present invention relates to an improved electronic musical instrument system arranged to readily set automatic performance data, various functions, such as tone color and effect functions, etc. of an electronic musical instrument on the basis of a musical score, lyrics, etc. of a music piece.

Among various examples of the conventionally-known electronic musical instruments are ones which prestore a plurality of sets of automatic performance data in a memory and can execute an automatic performance on the basis of a selected one of the prestored automatic performance data sets. Such automatic performance data can also be loaded from a disk recording medium or downloaded via a communication network.

Also known are electronic musical instruments which allow users to set various functions of tone color, performance effect, etc. Further, as seen in Japanese Patent Application Laid-open Publication No. 2003-208163, there have been known data called "registrations" or "regists" which include data for setting a tone color and effect of a first keyboard (lower keyboard) and data for setting a tone color and effect of a second keyboard (upper keyboard).

In an electronic organ, such registration data are allocated to regist switches provided on an operation panel. In response to operation of any one of the regist switches, the electronic organ is set to a performance style corresponding to the data allocated to the regist switch. There have also been services via which, when automatic performance data are to be delivered from a server via a network, registration data are delivered concurrently with the automatic performance data to allow an electronic musical instrument to utilize the registration.

It has also been known that training or practice on a musical instrument performance can be executed through execution, on an electronic musical instrument, of an automatic performance and a manual performance based on manual operation. In this case, automatic performance data of a music piece to be practiced are set into the electronic musical instrument. Further, among music papers having recorded thereon respective musical numbers or names of music pieces in question and performance-related information, such as registrations, suited for performances of the music pieces are those having barcodes and contents of the registrations added thereto. It has been known to set automatic performance data and make settings of equipment, using such information.

Electronic musical instruments capable of setting various functions, like the one disclosed in the aforementioned No. 2003-208163, can execute a music performance in a wide variety of variations. However, the functions to be set need be made to suit a music piece to be performed, and thus, operation for setting the functions tends to be cumbersome, particularly to a beginner. Furthermore, operation for selecting a particular set of automatic performance data, corresponding to a music piece represented on a music paper, from among a plurality of sets of automatic performance data stored in a memory also tends to be cumbersome. Namely, the conventionally-known electronic musical instruments present the problem that each user has to perform various cumbersome operation for setting various functions and automatic performance data. Further, because each user has to perform such operation while making various considerations and judgments, it has been difficult for beginners to adapt themselves to electronic musical instruments.

SUMMARY OF THE INVENTION

In view of the foregoing, it is an object of the present invention to provide a technique which can minimize a user's burden in setting an electronic musical instrument, make the electronic musical instrument easier to operate and allows the user to easily adapt to the electronic musical instrument.

In order to accomplish the above-mentioned object, the present invention provides an electronic musical instrument system, which comprises: a music-piece-related information object having music-piece-related information of a given music piece presented thereon, the music-piece-related information object also having attached thereto an RF tag that has stored therein equipment setting information related to a performance, by an electronic musical instrument, of the given music piece; and an electronic musical instrument having a performance operation section operable by a user to execute a performance. The electronic musical instrument further comprises: an information acquisition information that communicates with the RF tag to acquire the equipment setting information from the RF tag; and an automatic setting section that automatically sets various settings and states of the electronic musical instrument in accordance with the equipment setting information acquired by the information acquisition information. Here, the music-piece-related information is a musical score, lyrics or the like, and the music-piece-related information object is a printed music paper, lyric sheet (card) or the like.

With the aforementioned arrangements, the electronic musical instrument can be set to various settings and states suitable for the given music piece represented on the music-piece-related information object (music paper, lyric sheet or the like) by the user only setting the music-piece-related information object near the electronic musical instrument (e.g., on a music stand of the electronic musical instrument) so that the information acquisition section can receive information from the RF tag; thus, the arrangements of the present invention is very convenient to the user.

The RF tag and the information acquisition section together constitute, for example, an RFID (Radio Frequency Identification) system. The RF tag is also called "IC tag", "electromagnetic wave tag", "radio tag", "RFID tag" or the like, which is capable of storing various data in an IC memory provided therein. Data can be read and written, in a noncontact fashion, on the RF tag by means of a reader/writer as the information acquisition section of the electronic musical instrument. Thus, if a music paper or lyric sheet as the music-piece-related information is set on a music stand or the like as the music-piece-related information object, data stored in the RF tag can be read, in the electronic musical instrument, by the reader/writer provided near the music-piece-related information object. In the description of preferred embodiments below, the "RF tag" will be explained using its more common designation "IC tag".

According to the present invention, the equipment setting information stored in the RF tag is information related to a music piece presented on the music-piece-related information object, and by the user only setting the music-piece-related information object near (or on or in) the electronic musical instrument (or performing simple operation of a switch or the like after the setting of the music-piece-related information object), the electronic musical instrument can be automatically set to various settings and states suitable for the given music piece represented on the music-piece-related information object (music paper, lyric sheet or the like). For example, the equipment setting information pertaining to the music piece is information, such as parameter settings, (namely, tone color, registration, identification code and music piece name corresponding to (a set of) automatic performance data, automatic performance tempo, etc.) recommended by a content provider of the music-piece-related information object (music paper, lyric sheet or the like).

The electronic musical instrument may include an element that functions as a "trigger section" that triggers the data readout from the RF tag. In such a case, the information acquisition section itself functions also as the "trigger section" in reading the data from the RF tag when the music-piece-related information object (e.g., music paper) has been set, or in reading the data from a new RF tag in each turn of a page as will be later described. However, the "trigger section" may be provided separately in the electronic musical instrument. For example, a sensor may be provided for detecting the music-piece-related information object itself, or the data read from the RF tag may be triggered by the user operating an operator or the like of the electronic musical instrument.

The electronic musical instrument includes a storage section having automatic performance data of a plurality of music pieces stored therein, and the equipment setting information includes musical number identification information indicative of a name of the given music piece presented on the music-piece-related information object. The automatic setting section extracts the musical number identification information from the equipment setting information acquired from the RF tag, searches the storage section to search out automatic performance data of the given music piece on the basis of the extracted musical number identification information, reads out the searched-out automatic performance data from the storage section, and performs setting such that the electronic musical instrument executes an automatic performance based on the read-out automatic performance data. Thus, the electronic musical instrument can be automatically set to execute an automatic performance based on the automatic performance data of the given music piece represented on the music-piece-related information object (music paper, lyric sheet or the like).

The RF tag further has stored therein URL information of a server that supplies the automatic performance data of the given music piece. When the automatic performance data of the given music piece could not be searched out from the storage section on the basis of the extracted musical number identification information, the automatic setting section reads out the URL information from the RF tag, acquires, from a server on a network, the automatic performance data corresponding to the extracted musical number identification information, and performs setting such that the electronic musical instrument executes an automatic performance based on the acquired automatic performance data. Thus, even where the automatic performance data of the given music piece represented on the music-piece-related information object (music paper, lyric sheet or the like) are not stored in the electronic musical instrument, the automatic performance data can be automatically downloaded from the server on the network.

The equipment setting information includes function setting data for setting various functions of an electronic musical instrument related to a performance of the given music piece, and the automatic setting section of the electronic musical instrument extracts function setting data from the equipment setting information acquired from the RF tag, and sets the various functions of the electronic musical instrument on the basis of the extracted function setting data. Thus, the electronic musical instrument can be automatically set to tone generation/control functions suitable for the given music piece represented on the music-piece-related information object. For example, the function setting data are various setting parameters, such as tone color parameters and effect parameters, in which case various functions for a tone color, effect (e.g., reverberation), etc. can be set to suit the music piece.

As a preferred example, when the automatic performance data of the given music piece could not be searched out from the storage section on the basis of the extracted musical number identification information, the automatic setting section identifies automatic performance data similar to the automatic performance data indicated by the musical number identification information, reads out the identified similar automatic performance data from the storage section, and performs setting such that the electronic musical instrument executes an automatic performance based on the read-out automatic performance data. Thus, automatic performance data similar to the automatic performance data of the given music piece represented on the music-piece-related information object (music paper, lyric sheet or the like) can be automatically set, which allows the electronic musical instrument to have an enhanced flexibility.

As a preferred example, when the electronic musical instrument can not be set to a function indicated by the extracted function setting data, the automatic setting section sets the electronic musical instrument to a function similar to the function indicated by the extracted function setting data. Because the functions indicated by the extracted function setting data can be substituted for by similar functions, the electronic musical instrument is allowed to have an enhanced flexibility. For example, if the electronic musical instrument does not have a special guitar tone color, it is set to an ordinary guitar tone color.

As a preferred example, the automatic setting section sets the electronic musical instrument to functions suitable for the electronic musical instrument, by reading the function setting data. For example, if the function setting data is a parameter indicating "great reverberation", it is converted into a maximum value of the parameter such that the electronic musical instrument is set to a maximum reverberation setting.

As a preferred example, the RF tag further has stored therein URL information of a server that supplies performance technique information related to the given music piece, the electronic musical instrument includes a display device, and the automatic setting section reads out the URL information from the RF tag, acquires, from a server on a network, the performance technique information, and displays the acquired performance technique information on the display device. Such arrangements can achieve a convenient way to learn how to perform (i.e., technique for performing) the music piece. For example, in a case where the instant electronic musical instrument system is used as a musical instrument performance training system, the aforementioned arrangements can achieve a convenient way to teach how to perform (i.e., technique for performing) the music piece, if the URL of the server providing the performance technique is prestored in the RF tag in relation to the desired training music piece.

As a preferred example, the equipment setting information includes performance position data indicative of a particular performance position in the given music piece, and the automatic setting section sets, in accordance with the performance position data included in the acquired equipment setting information, an automatic performance position or performance guide position of the given music piece to be performed by the electronic musical instrument. It is assumed here that, in order to permit setting of a performance guide position, the electronic musical instrument is provided with a conventionally-known performance guide device for displaying, to the user, how to perform a keyboard or the like as a visual performance guide. Namely, the performance guide position is a position of a performance operator (e.g., key) indicated by the performance guide device to the user. For example, in the case where the instant electronic musical instrument system is used as a musical instrument performance training system, the above-mentioned performance guide position corresponds to a training position in the training of the given music piece. Thus, as pages of a music paper are turned, a reproduction position of an automatic performance or training position can be automatically changed.

As a preferred example, when new equipment setting information has been acquired during the course of an automatic performance or performance guide of the given music piece, and once the automatic performance or performance guide progresses to a predetermined breakpoint, the automatic setting section updates, in accordance with the performance position data included in the acquired equipment setting information, an automatic performance position or performance guide position of the given music piece to be performed by the electronic musical instrument and sets the updated automatic performance position or performance guide position. Thus, in a case where the music-piece-related information object is in the form of a music paper book, the automatic performance or performance guide is allowed to progress smoothly even when the pages of the music paper are turned ahead of the automatic performance or performance guide, which thereby facilitates page-turning operation.

According to another aspect of the present invention, the electronic musical instrument further comprises a trigger section that triggers the information acquisition section to acquire the equipment setting information from the RF tag. When the information acquisition section has acquired new equipment setting information in response to triggering by the trigger section, the automatic setting section sets states of the electronic musical instrument in accordance with the acquired new equipment setting information.

As an example, the music-piece-related information object comprises a plurality of double-page spreads with the RF tag provided on each of the double-page spreads, each of the RF tags having stored therein equipment setting information related to a progression of a music piece on a corresponding one of the double-page spreads, and the trigger section of the electronic musical instrument detects updating of the double-page spread of the RF tag and triggers the information acquisition section to acquire the equipment setting information from the RF tag in the updated double-page spread. Thus, in the case where the music-piece-related information object is in the form of a music paper book, and if arrangements are made to trigger, by means of the trigger section, the data read from the RF tag upon page-turning of the music paper book, the electronic musical instrument can be set so that, upon page-turning of the music paper book, it is shifted to a reproduction position, tone color, effect, etc. at the head position of the newly-opened double-page spread of the music paper book.

As an example, the equipment setting information includes performance position data indicative of a particular performance position in the given music piece. When the information acquisition section has acquired new equipment setting information in response to triggering by the trigger section, the automatic setting section sets, in accordance with the performance position data included in the acquired new equipment setting information, an automatic performance position or performance guide position of the given music piece to be performed by the electronic musical instrument. Thus, in the case where the music-piece-related information object is in the form of a music paper book, the reproduction position of an automatic performance or training position can be automatically changed as the pages of the music paper are turned.

As an example, the electronic musical instrument has a function for executing an automatic performance on the basis of automatic performance data. When the new equipment setting information has been acquired during the course of an automatic performance or performance guide based on the automatic performance data, and once the automatic performance or performance guide progresses to a predetermined breakpoint, the automatic setting section updates, in accordance with the performance position data included in the new equipment setting information, the automatic performance position or performance guide position of the given music piece to be performed by the electronic musical instrument and sets the updated automatic performance position or performance guide position. Thus, in the case where the music-piece-related information object is in the form of a music paper book, the automatic performance is allowed to progress smoothly even when the pages of the music paper are turned over ahead of the automatic performance, which thereby facilitates page-turning operation.

As an example, the equipment setting information includes function setting data for setting various functions in relation to a performance position in the given music piece. When the information acquisition section has acquired new equipment setting information in response to triggering by the trigger section, the automatic setting section sets, in accordance with the function setting data included in the acquired new equipment setting information, various functions of the electronic musical instrument in relation to the performance position. Thus, in an automatic performance or training performance, various functions (tone color, effect, etc.) can be appropriately reproduced in accordance with a progression of the performance position.

As an example, the electronic musical instrument includes a display device, and the equipment setting information includes musical score data of the given music piece. When the information acquisition section has acquired new equipment setting information in response to triggering by the trigger section, the automatic setting section displays, on the display device, a musical score corresponding to the updated double-page spread on the basis of the musical score data included in the acquired new equipment setting information. Thus, the user can check the musical score of the music paper on the display device as well.

The present invention may be constructed and implemented not only as the system and apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION OF THE INVENTION

Figure 1A:
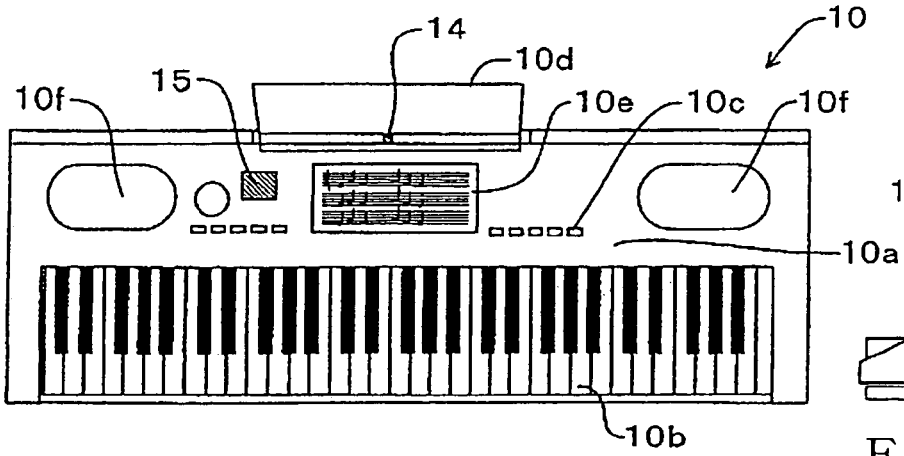
FIGS. 1A and 1B are plan and side views, respectively, showing an electronic musical instrument according to an embodiment of the present invention.
Figure 1B:
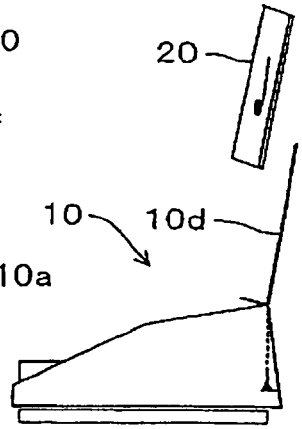
Figure 2:
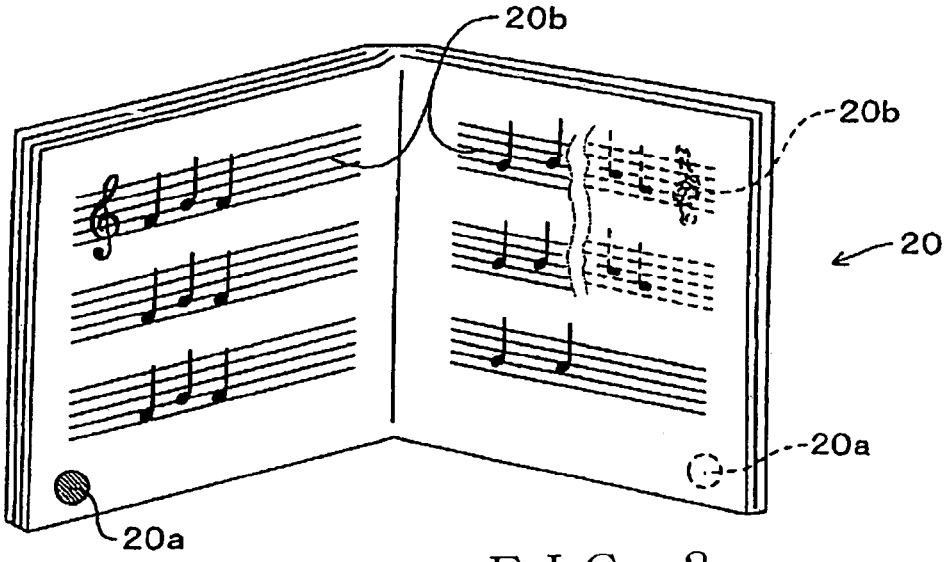
FIG. 2 is a view showing a music paper for use in the embodiment.
Figure 3:
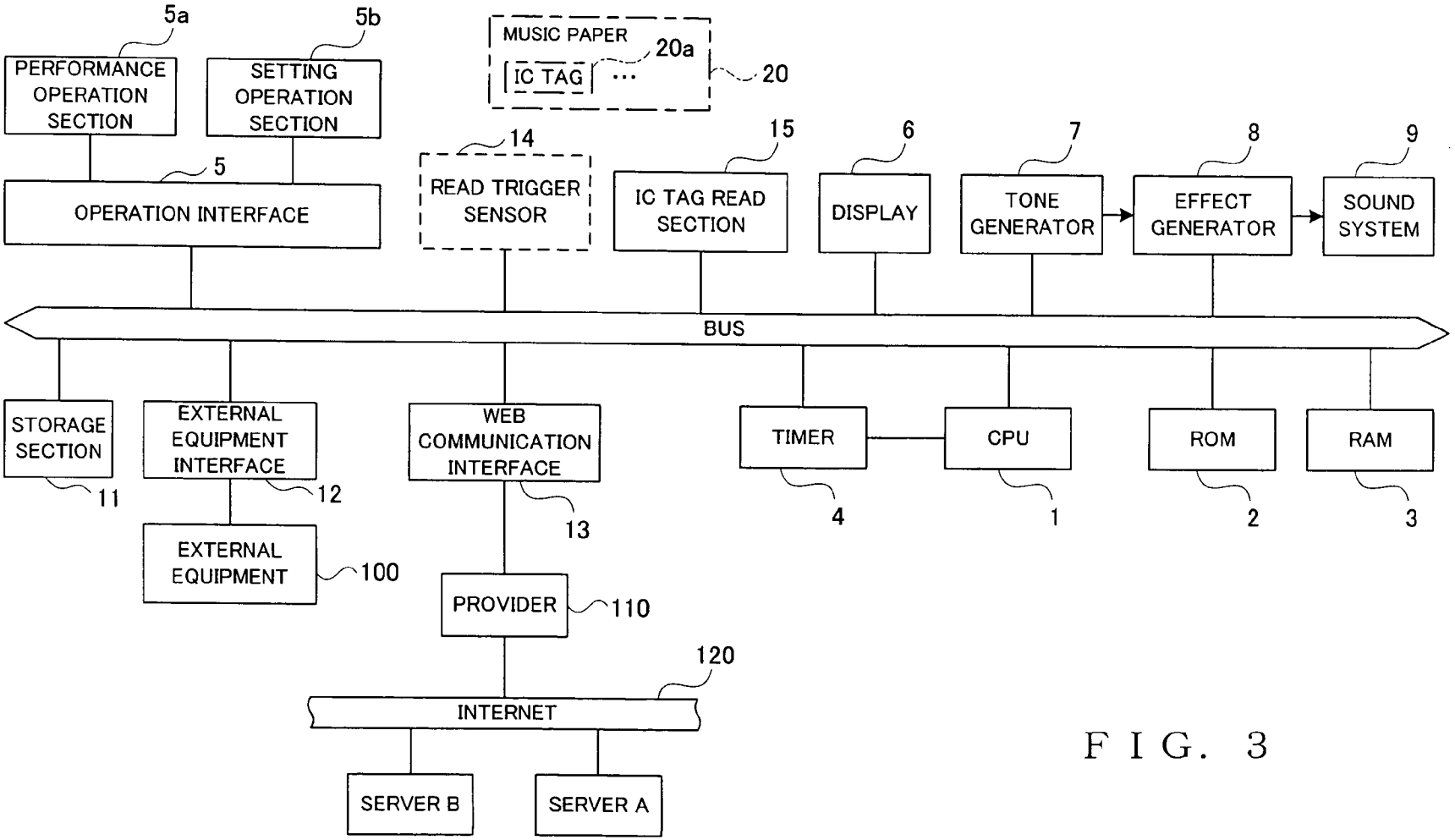
FIG. 3 is a hardware block diagram showing the electronic musical instrument, peripheral equipment and network.

FIGS. 1A and 1B are plan and side views, respectively, showing an electronic musical instrument according to an embodiment of the present invention. FIG. 2 is a view showing a music paper for use in the embodiment, and FIG. 3 is a hardware block diagram showing the electronic musical instrument, peripheral equipment and network.

As shown in FIG. 1, the electronic musical instrument 10 is an electronic keyboard instrument, where a keyboard 10*b* as a performance operation section is disposed on a front portion (i.e., portion closer to a human player (not shown) playing the musical instrument 10) of a panel surface 10*a*. On the panel surface 10*a*, there are provided various switches 10*c* operable to select a tone color for a manual performance on the keyboard 10*b*, select a music piece to be automatically performed, set a tempo and set various effects. Further, a music stand 10*d* for placing thereon a music paper 20 is disposed on a rear middle portion of the panel surface 10*a*, and a later-described read trigger sensor 14 as a "new-setting trigger means" is provided on the music stand 10*d*. Further, a later-described IC tag read section 15 as an "information acquisition means" is provided on the panel surface 10*a* adjacent to the left end of the music stand 10*d*.

Further, a display screen 10*e* as a "display means", such as a liquid crystal panel, is provided on a middle region of the panel surface 10*a*, various setting information, such as music piece names, tone colors, etc. of automatic performance data stored in a storage section etc. of the body of the electronic musical instrument, is displayed on the display screen 10*e* to provide an assisting guide for operation for selecting an ordinary music piece and for setting operation. Also displayed on the display screen 10*e* are various performance-related data, such as a musical score, lyrics and performance technique information, as well as information to be communicated with external equipment. Sounding sections 10*f* for audibly generating tones via built-in speakers are provided on opposite side regions of the panel surface 10*a*.

As shown in FIG. 2, later-described IC tags (i.e., RF tags) 20*a* are embedded in the music paper 20 as "music-piece-related information object". Further, a musical score 20*b* as "music-piece-related information" is printed (presented) on the music paper 20. Each of the IC tags 20*a* has stored therein equipment setting information about a music piece represented by the musical score 20*b*. As will be later described, details of the equipment setting information stored in the plurality of IC tags 20*a* differ among the tags 20*a* depending on the corresponding musical score, even for the same music piece. For example, the equipment setting information of the IC tag 20*a* indicated by solid lines in FIG. 2 includes performance position data indicative of the head of the solid-line musical score 20*b* of a double-page (i.e., left-and-right-page) spread, and data corresponding to a tone color, effect, etc. of the musical score 20*b*. Further, the equipment setting information of the IC tag 20*a* indicated by broken lines in FIG. 2 includes performance position data indicative of the head of the musical score 20*b*, indicated in broken lines, of a next double-page (left-and-right-page) spread, and data corresponding to a tone color, effect, etc. of the broken-line musical score 20*b*.

Referring to FIG. 3, a CPU 1 controls the entire electronic musical instrument on the basis of a control program stored in a ROM 2 and using a working area of a RAM 3. Timer 4 is a circuit for generating clock pulse signals for defining performance timing of automatic performance processing, etc. As a conventional fundamental function of the electronic musical instrument, the CPU 1 detects, via an operation interface 5, operation events of a performance operation section 5*a*, such as the keyboard 10*b* and a not-shown pedal, to thereby control a manual performance. Further, the CPU 1 detects, via the operation interface 5, operation events of a setting operation section 5*b*, such as the above-mentioned switches 10*c*, to perform processing corresponding to the detected operation. The setting operation section 5*b* is operable to select/set various functions of the equipment, e.g. to set a tone color and effect, set an accompaniment of an automatic performance and set a music piece. Further, the CPU 1 controls displayed content on the display 6 providing the display screen 10*e*.

Tone generator 7 generates a tone signal in accordance with various data set via the CPU 1 in response to a manual performance or automatic performance and outputs the generated tone signal to an effect device 8. The effect device 8 imparts the tone signal with an effect in accordance with settings made via the CPU 1 and outputs the thus effect-imparted to a sound system 9. The sound system 9 performs D/A conversion, amplification, etc. on the tone signal and then sounds or audibly reproduces the tone signal via speakers.

Storage section 11, external equipment interface 12 and web communication interface 13 are components for acquiring automatic performance data and equipment setting information. The storage section 11, which is a storage device (e.g., hard disk) provided in the electronic musical instrument 10, has a plurality of sets of automatic performance data prestored therein. The external equipment interface 12, which is an interface for external equipment 100 (e.g., personal computer or external storage device), can communicate (i.e., transmit/receive) desired automatic performance data with (to/from) the external equipment 100. The web communication interface 13 is connected, for example, to a LAN to communicate information with a desired server via a provider 110 and Internet 120 connected with the LAN. User can designate an URL of a service-providing server A, server B or the like, connected to the Internet, to acquire desired information from the designated server. These service-providing servers A, B, etc. have stored therein various automatic performance data and equipment setting information for electronic musical instruments and carries out delivery service of these data.

The read trigger sensor 14 and IC tag read section 15 are provided to carry out the present invention. For example, the read trigger sensor 14 irradiates an infrared ray beam and detects infrared ray reflection from an object (e.g., music paper 20) located adjacent to the sensor 14. On the basis of a detection signal output from the read trigger sensor 14, the CPU 1 detects that the music paper 20 or the like has been placed on the music stand 10*d*. The IC tag read section 15, which is a reader/writer constituting an RFID (Radio Frequency ID) system, reads data from the IC tag 20*a* provided in the music paper 20 and forwards the thus-read data to the CPU 1.

Whereas there are presently known various standards for RFID systems, like the one comprising the IC tag 20*a* and IC tag read section 15, the system of the instant embodiment is an electromagnetic induction type. Namely, the IC tag read section 15 produces a magnetic field with a current supplied to a coiled antenna thereof, and electric power is produced in an antenna of the IC tag 20*a* through electromagnetic induction by the magnetic field. The IC tag 20*a* activates its internal control circuit and memory, through the power production, to transmits data, stored in the internal memory, using a magnetic field. The thus-transmitted data is received by the IC tag read section 15. In the case of the electromagnetic-induction type system, a maximum distance over which data can be transmitted/received is about 10 cm; thus, a distance between the music stand 10*d* and the IC tag read section 15 is set to meet such a distance requirement.

The IC tag 20*a* is provided at a corner region of each double-page spread of the music paper 20, and as the pages of the music paper 20 are turned, one IC tag 20*a* will overlap another on a side area of the music paper 20 adjacent to the IC tag read section 15. The RFID system in the instant embodiment has an "anti-collision (collision prevention)" function, so that the IC tag read section 15 can accurately read and write data simultaneously on a plurality of the IC tags 20*a*. Thus, when the IC tag 20*a* of a newly-opened double-page spread (i.e., new IC tag 20*a*) has come close to the IC tag read section 15 as the pages of the music paper 20 are turned, the CPU 1 can detect the coming of the new IC tag 20*a* (i.e., new page-turning). Further, even when the pages of the music paper 20 are turned in the opposite direction (i.e., away from the IC tag read section 15), the CPU 1 can detect the page-turning in the opposite direction because no data can be received from the IC tag 20*a* of the closed double-page spread. The IC tag 20*a* of each of the double-page spreads has stored therein identification information (e.g., page number) of the double-page spread, so that the CPU 1 can identify each of the double-page spreads from the respective identification information.

The following paragraphs describe a specific example of the "equipment setting information" used in the instant embodiment.

As well known, the musical score 20*b* printed on the music paper 20 represents a progression of a music piece. In the IC tag 20*a*, there is stored equipment setting information pertaining to a performance of the music piece to be executed, manually or automatically, on the electronic musical instrument 10. In the following description, the music piece or automatic performance data of the music piece, represented by the musical score 20*b*, will be referred to as "score music piece" as necessary.

The equipment setting information includes various "function setting data", such as tone color parameters indicative of a tone color (including a type of a musical instrument) to be used for a performance of the score music piece, parameters of various effects like a reverberation effect and panning. The equipment setting information also includes "musical number identification information" indicative of a name or the like of automatic performance data of the score music piece. The equipment setting information also includes "performance position data" indicative of timing in the automatic performance data of the score music piece and corresponding to the head of the musical score 20*b* on each double-page spread of the music paper 20.

As well known, automatic performance data are prepared in various formats. For example, each automatic performance data set comprises a plurality of sets of data of tone pitches, touches, tone generation timing and gate times corresponding to all notes in a music piece. Each automatic performance data set may also include, as necessary, data indicative of tonality and various auxiliary data. The performance position (performance position data) of the automatic performance data is represented as data of timing indicated by the number of measures, beats and clock pulses from the beginning of the music piece, using, as basic time units, clock pulses of predetermined resolution, such as 96 clock pulses per measure in four-four time. In the case of automatic performance reproduction, the "performance position" is synonymous with a "reproduction position".

The above-mentioned equipment setting information is information recommended by a content provider who supplies the music paper 20 or automatic performance data. The equipment setting information is read out from the IC tag 20*a*, and the CPU 10 sets states of the electronic musical instrument 10 on the basis of the equipment setting information in any of various manners as noted below.

For example, if the "function setting data" is a parameter value pertaining to function setting, the parameter value may be used directly as a setting of the electronic musical instrument 10. If the function setting data is some information pertaining to function setting, the information may be interpreted and then converted into a parameter value suiting the electronic musical instrument 10, and then the converted parameter value may be set into the electronic musical instrument 10. For example, if the information is a reverberation effect parameter indicating "great reverberation", the information may converted into a maximum value of a reverberation parameter used in the instrument 10 such that the electronic musical instrument 10 is set to a maximum reverberation setting. Further, if a parameter of a particular function (such as a tone color or effect) designated by the "function setting data" can not be set into the electronic musical instrument 10, the parameter of the particular function may be converted into a parameter of another function and the parameter of the other function may be set into the musical instrument 10 so that the other function can be used as a substitute for the designated function.

If the "musical number identification information" is an identification code designating a set of automatic performance data, a search is made through identification codes of sets of automatic performance data stored in the storage section 11 or the like of the electronic musical instrument 10. If the same identification code has been found or searched out from among the stored identification codes, then the automatic data set of the identification code is set into the RAM 3. If the "musical number identification information" is a music piece name, a search is made through music piece names stored in the storage section 11 or the like of the electronic musical instrument 10. If the same music piece name has been found or searched out from among the stored music piece names, then the automatic data set of the music piece name is set. If exactly the same music piece name has not been found from among the stored music piece names, then a search is made for a music piece name, having the same reading as the music piece name indicated by the musical number identification information but different in type of letters, such as full-size and half-size, Chinese characters, hiragana and katakana, Roman letters and katakana, and the thus-found music piece name is selected and set. In case the same identification code or the music piece name of the same reading has not been found from among the stored identification codes or music piece names, then an automatic performance data set of a music piece name similar to the designated music piece name or of the same genre as the designated is selected and set.

It is desirable that the "performance position data" and "musical number identification information" be stored, as a set or in combination, in the IC tag 20*a*. In such a case, an automatic performance data set is automatically set on the basis of the musical number identification information read from the IC tag 20*a*. The performance position data read from the IC tag 20*a* corresponds to the head performance position of the musical score 20*b* of one double-page spread of the music paper 20, and control is performed such that an automatic performance is reproduced staring at the head performance position. In an alternative, only the performance position data may be stored in the IC tag 20*a*. In such a case, the "musical number identification information" of the automatic performance data set, corresponding to the musical score 20*b* of the music paper 20, is printed in advance, and the user sets the automatic performance data set by, for example, performing panel operation on the basis of the "musical number identification information". In this way, the performance position data read from the IC tag 20*a* can correspond to a performance position of the automatic performance data.

Behavior and functions of the instant embodiment are outlined below. The user can select a desired one of a "manual operation mode" and "automatic processing mode" through operation on the setting operation section 5*b*. The "manual operation mode" is a mode in which a set of automatic performance data is selected and set through manual operation. The "automatic processing mode" is a mode in which automatic performance data and function setting parameters (hereinafter referred to as "function parameters"), etc. are automatically set on the basis of the information stored in the IC tag 20*a* of the music paper 20. For reproduction of automatic performance data, a selection can be made between an "automatic performance mode" for audibly generating tones on the basis of the automatic performance data and a "performance guide (training performance) mode" for, for example, illuminating each key to be depressed on the keyboard 10*b*. The selection between the automatic performance mode and the performance guide mode too can be made through operation on the setting operation section 5*b*.

Figure 4:
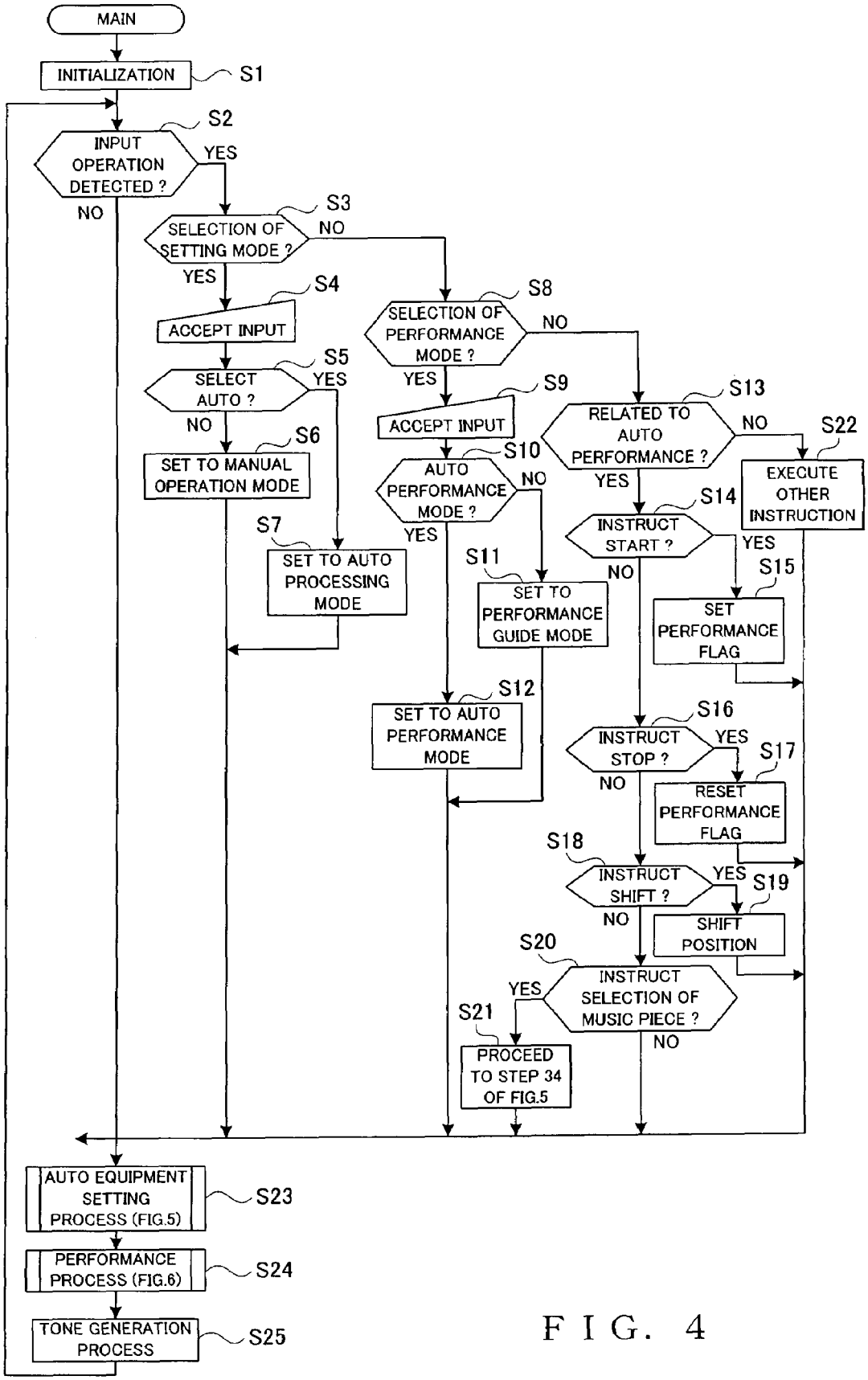
FIG. 4 is a flow chart of main processing performed in the embodiment.
Figure 5:
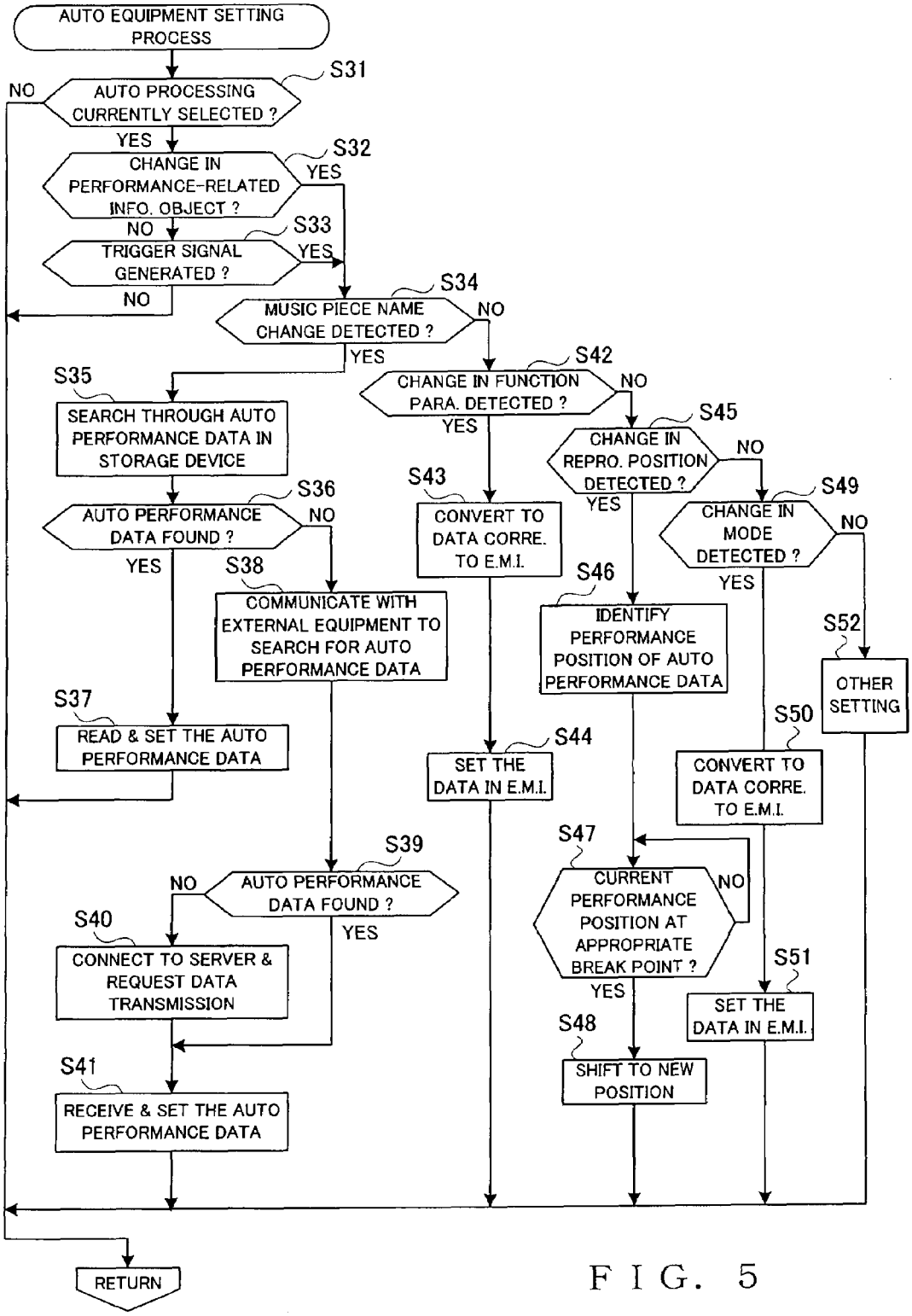
FIG. 5 is a flow chart of an automatic equipment setting process performed in the embodiment.
Figure 6:
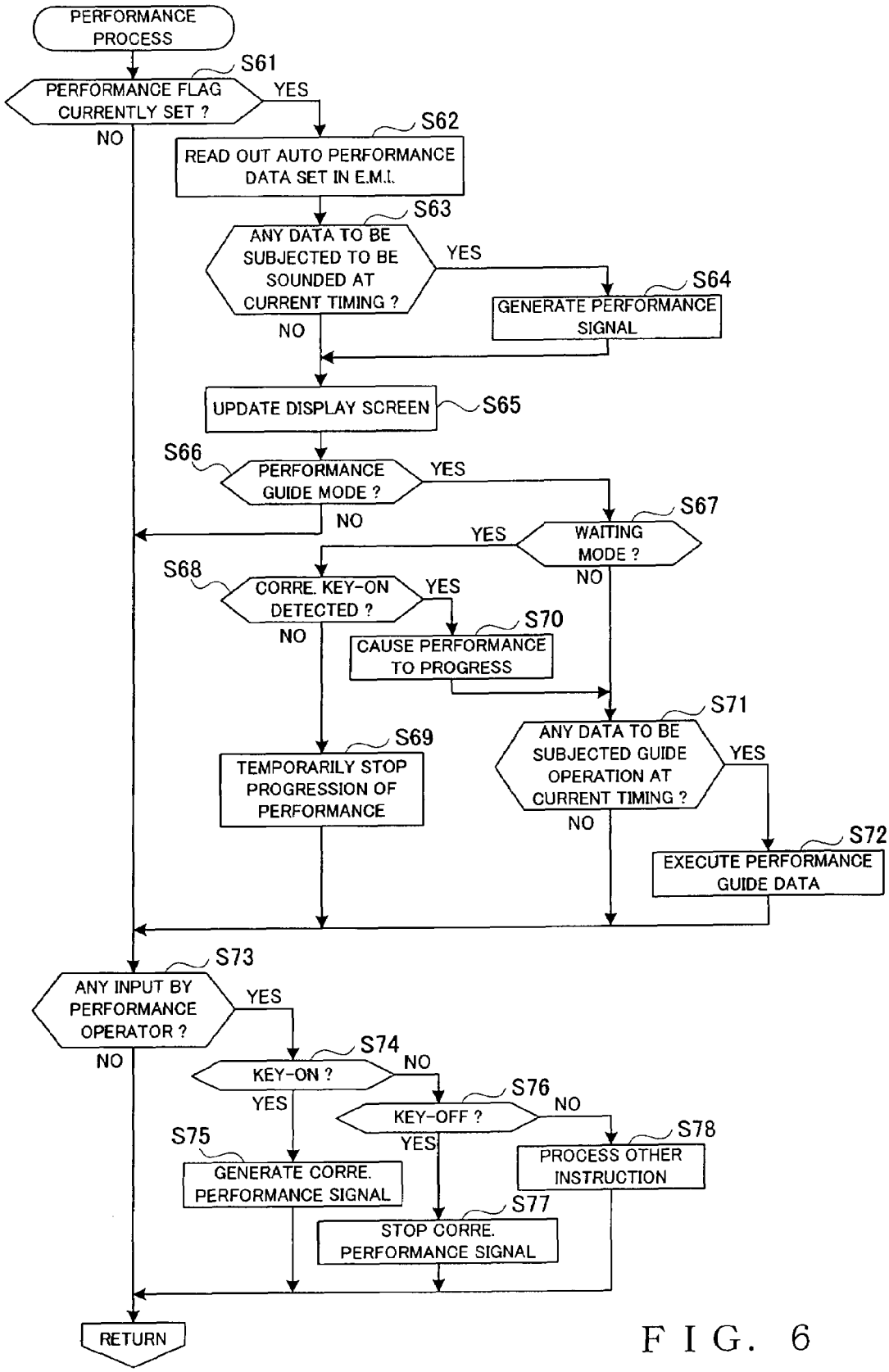
FIG. 6 is a flow chart of a performance process performed in the embodiment.
Figure 7:
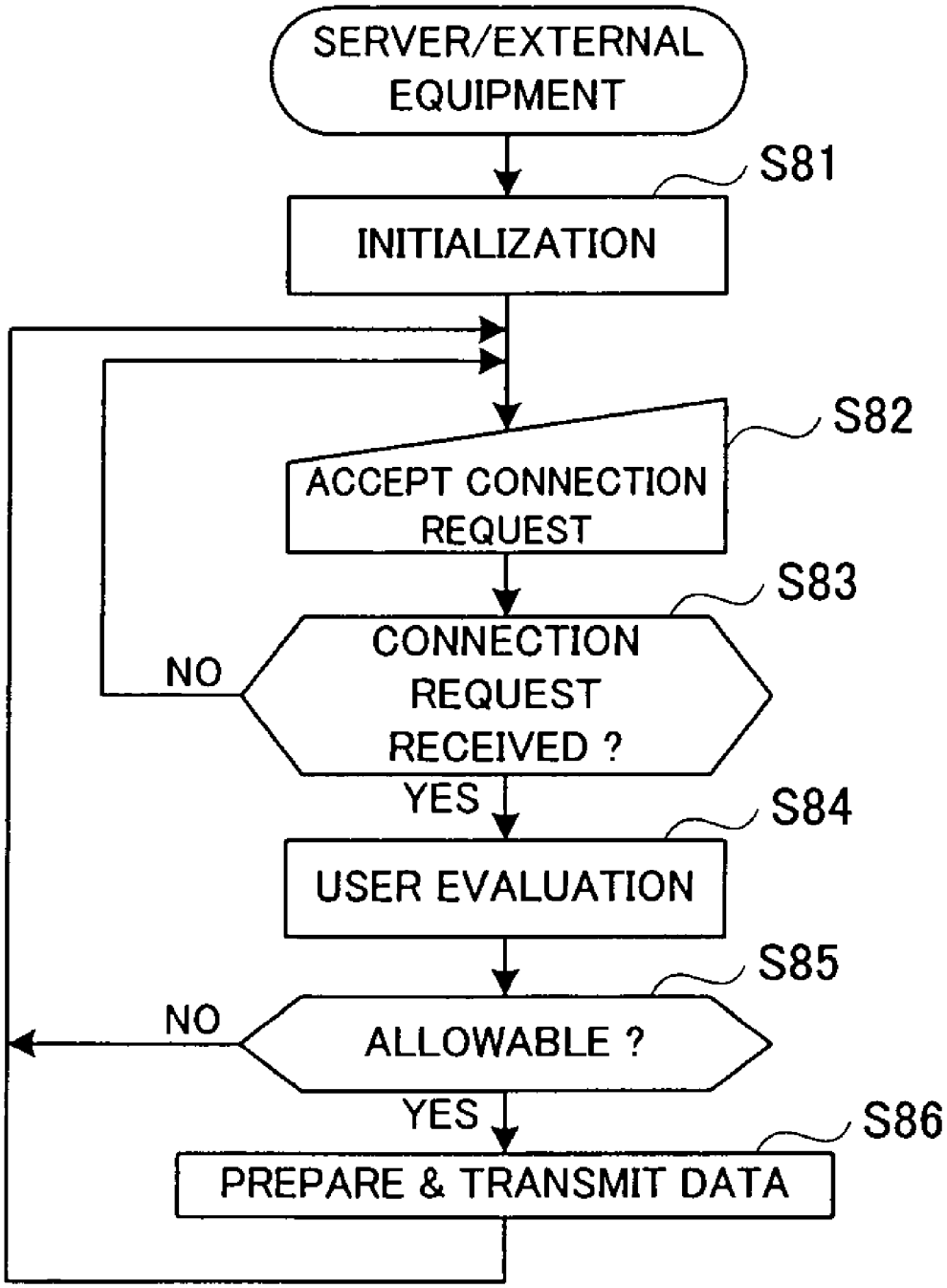
FIG. 7 is a flow chart of a server process performed in the embodiment.

The following paragraphs describe behavior of the embodiment with reference to various flow charts. FIG. 4 is a flow chart of main processing, FIG. 5 is a flow chart of an automatic equipment setting process, FIG. 6 is a flow chart of a performance process, and FIG. 7 is a flow chart of a server process. As seen from the following description and flow charts, programs represented by the flow charts and functions achieved by the CPU 1 performing these programs correspond to an "automatic setting section" in the appended claims. Further, in the following description and flow charts, a performance flag is a flag for controlling an automatic performance (including performance guide), and the performance flag in an ON (or set) position indicates a state after a start of an automatic performance has been instructed while the performance flag in an OFF (or reset) position indicates a state after a stop of an automatic performance has been instructed. States of various operation modes are stored by, for example, setting/resetting of flags corresponding to the modes etc., and it is assumed here that, when one of each pair of complementary modes is set, the other is reset.

The main processing of FIG. 4 is started up upon powering-on of the electronic musical instrument 10, where an initialization process is first performed at step S1 for resetting various flags and registers, etc. and steps S2-S25 are repeated while the power supply is ON. More specifically, a determination is made, at step S2, as to whether there has been any input operation performed on the setting operation section 5*b*. If there has been no input operation performed on the setting operation section 5*b* as determined at step S2, the processing proceeds to step S23. But, if there has been input operation performed on the setting operation section 5*b*, operations corresponding to various types of the input operation performed are performed at steps S3, S8, S13 and S22 to make various settings of the electronic musical instrument 10.

If the input operation performed is operation for selecting one of setting modes, i.e. manual operation mode or automatic processing mode, as determined at step S3, the selection is accepted at step S4. If the input operation performed is not operation for selecting the automatic processing mode as determined at step S5, the operation mode of the electronic musical instrument 10 is set to the manual operation mode (conventional mode) at step S6, after which the processing goes to step S23. In the manual operation mode, a predetermined display is made on the display screen 10*e* (display 6), and operations are performed for prompting the user to enter a desired musical number and accepting the music piece name entry. If the input operation performed is operation for selecting the automatic processing mode as determined at step S5, the operation mode is set to the automatic processing mode (the flag is set) at step S7, after which the processing proceeds to step S23.

In the automatic processing mode, the IC tag read section 15 is activated, so that, once data is transmitted from an IC tag 20*a* of the music paper 20 set on the music stand 10*d*, the IC tag read section 15 receives the data and obtains the musical number identification information. If no music paper 20 is currently set on the music stand 10*d* and thus no data from an IC tag 20*a* is detected, a display is made on the display screen 10*e* for prompting the user to set a music paper. In a case where a music paper is set after the activation of the IC tag read section 15 or the like, detection of an IC tag 20*a* and data reception is carried out at later-described step S32 of FIG. 5 during looped repetition of the main processing. In the case where no IC tag 20*a* has been detected, an error display or the like may be made, and the operation mode may be switched to the manual operation mode in which the user is allowed to manually enter a desired music piece name.

Then, if the input operation is operation for selecting a performance mode as determined at step S8, the processing goes to step S9 to accept the mode selection. If the input operation is not operation for selecting the automatic performance mode as determined at step S10, the processing branches to step S11 in order to set the electronic musical instrument 10 to the performance guide mode (training mode) (to set the flag), after which the processing proceeds to step S23.

Further, if the input operation is operation related to an automatic performance (including a performance guide) as determined at step S13, operations of steps S14-S21 are performed. If the input operation is operation instructing a start of an automatic performance, the performance flag is set, while, if the input operation is operation instructing an end of an automatic performance, the performance flag is reset. After that, the processing goes to step S23. If the input operation is operation instructing a position shift of an automatic performance, the automatic performance is shifted from one performance position to another in accordance with the instruction, after which the processing goes to step S23. Further, if the input operation is operation instructing a selection of a music piece, the processing proceeds to step S34 of FIG. 5 at step S21. Further, if the input operation is other operation than the aforementioned, another operation is carried out at step S22.

The automatic equipment setting process of FIG. 5 is performed at step S23, and the performance process of FIG. 6 is performed at step S24. Then, a tone generation process is performed at step S25, after which the processing reverts to step S2.

In the automatic equipment setting process of FIG. 5, a determination is made, at step S31, as to whether or not the automatic processing mode is currently selected. If the automatic processing mode is not currently selected as determined at step S31, the process returns to the main processing routine, while, if the automatic processing mode is currently selected, operations at and after steps S32 are performed. At step S32, a determination is made as to whether there has occurred a change in the music-piece-related (or performance-related) information object, e.g. as to whether a music paper 20 has been set on the music stand 10*d* or whether the page of a music paper 20 already set on the music stand 10*d* has been updated. Because the IC tag read section 15 has already been activated when the automatic processing mode is selected, the above determination can be made on the basis of whether a new IC tag 20*a* has been detected by the IC tag read section 15 or on the basis of data received from the new IC tag 20*a*. If no change has occurred in the performance-related information object, a further determination is made, at step S33, as to whether there has been generated a trigger signal. If no trigger signal has been generated as determined at step S33, the process returns to the main processing routine, while, if a trigger signal has been generated, the process goes to step S34. Note that such a trigger signal is a switch signal generated by the user operating a predetermined switch or a detection signal generated by the read trigger sensor 14 detecting setting, on the music stand 10*d*, of a music paper 20.

At step S34, a comparison is made between the musical number identification information included in the data received from the IC tag 20*a* and the musical number of the currently-set automatic performance data, to determine whether there has occurred a change in the music piece name (musical number identification information). If no automatic performance data is currently set, it is determined at this step that there has occurred a change; this corresponds to a situation where no music paper 20 was on the music stand 10*d* when the operation mode has been set to the automatic processing mode at step S7, and a music paper 20 has been set on the music stand 10*d* at a later time. If there has occurred no change in the music piece name as determined at step S34, the process goes to step S42 to perform operations at and after step S42, while, if there has occurred a change in the music piece name, the process goes to step S35.

At step S35, a search is made, on the basis of the new musical number identification information, through automatic performance data sets stored in a storage device of the storage section 11. Then, at step S36, a determination is made as to whether an automatic data set corresponding to the new musical number identification information has been found or searched out from among the stored automatic performance data sets. With a YES determination at step S36, the corresponding automatic performance data set is read out at step S37 and set into the EAM 3. If, on the other hand, no corresponding automatic performance data set has been found, the CPU 1 communicates with the external equipment 100 to search through automatic performance data sets stored in the external equipment 100, and then at step S39, a determination is made as to whether an automatic data set corresponding to the new musical number identification information has been found or searched out from among the stored automatic performance data sets stored in the external equipment 100. With a YES determination at step S39, the searched-out corresponding automatic performance data set is received from the external equipment 100 and set into the RAM 3, after which the process returns to the main processing routine. If, on the other hand, such a corresponding automatic performance data set has not been found, the CPU 1 connects to a server on the basis of the URL read out from the IC tag 20*a* in correspondence with the musical number identification information and requests data transmission from the server. At next step S41, the corresponding automatic performance data set is received and set into the RAM 3, after which the process returns to the main processing routine.

If there has occurred no change in the music piece name as determined at step S34, the received data are examined and operations corresponding to other information than the musical number identification information are performed, at steps S42, S45, S49 and S52, to make various settings for the electronic musical instrument 10.

More specifically, if there has occurred a change in any of the function parameters based on the received data as determined at step S42, the function parameter is converted into data corresponding to the electronic musical instrument (E.M.I.) 10 at step S43 and set into the electronic musical instrument (E.M.I.) 10 at step S44, after which the process returns to the main processing routine. Then, if there has occurred a change in the reproduction position of the automatic performance based on the received data as determined at step S45, the new reproduction position is identified as a performance position in the current automatic performance data at step S46. At next step S47, it is monitored when the current performance position reaches an appropriate breakpoint (e.g., position of a bar line). Once the current performance position reaches such an appropriate breakpoint, the current reproduction position of the automatic performance is changed to the new reproduction position, after which the process returns to the main processing routine.

If there has occurred a change in the operation mode based on the received data as determined at step S49, the operation mode designating data is converted into data corresponding to the electronic musical instrument 10 at step S50 and set into the electronic musical instrument 10 at step S51, after which the process returns to the main processing routine. If there has occurred no change in the operation mode as determined at step S49, other settings are made at step S52, after which the process returns to the main processing routine.

With the aforementioned operations, when the page of the music paper 20 has been updated, for example, a tone color, effect, etc. are changed/set in accordance with function parameters corresponding to a musical score 20*b* of the new page (double-page spread). As noted above, information related to function setting may be converted to an appropriate parameter value on the basis of the interpretation of the information; for example, if the information indicates that the reverberation is to be increased, the reverberation parameter of the electronic musical instrument is set to a maximum parameter value. If the information represents a particular function (such as a tone color or effect) of a type that can not be set in the electronic musical instrument, the function may be substituted for by a similar function. Further, the automatic performance shifts to a reproduction position corresponding to the head position of the musical score 20*b* of the new page; at that time, the performance is reproduced starting at the new position after completion of reproduction of a measure of a melody. It is even better to change the reproduction position after performances of corresponding measures in the musical scores corresponding to a plurality of tracks have been completed. Note that the reproduction position change may be effected immediately after detection of page updating without waiting for completion of one measure. Further, if there has occurred a change from the operation mode currently set in the musical instrument 10, the newly acquired operation mode is set in the musical instrument 10. For example, the operation mode is changed to a mode in which keys to be depressed on the keyboard 10*b* are illuminated in the training mode, or to a waiting mode.

In the performance process of FIG. 6 (step S24 of FIG. 24), a determination is made, at step S61, as to whether the performance flag is currently set. If answered in the negative at step S61, it means that no automatic performance is currently being executed, and thus the process goes to step S73 in order to perform a manual performance process. If, on the other hand, the performance flag is currently set, it means that an automatic performance is currently being executed (or that an automatic performance start instruction has just been given), and thus, automatic performance operations are performed at steps S62-S67, after which the process goes to step S73.

At steps S62, S63 and S64, a determination is made as to whether any of the automatic performance data currently set in the electronic musical instrument 10 is to be sounded (or audibly reproduced) at the current timing, and, if so, an operation is performed for generating a performance signal of the data. If the instrument 10 is currently set to display a musical score and lyrics, the display of the display screen 10*e* is updated, at step S65, in accordance with a progression of the automatic performance. If there has occurred a change in the reproduction position based on the information from the IC tag 20*a*, then the display position is also changed similarly to the tone generation change.

At next step S66, a determination is made as to whether the current operation mode is the performance guide mode. With a NO determination at step S66, the process goes to step S73. If, on the other hand, the current operation mode is the performance guide mode, operations in the performance guide mode are performed at steps S67-S72. If the waiting mode is not ON as determined at step S67, the process goes to step S71, while, if the waiting mode is ON, it is further determined, at step S68, whether there has occurred a key-on event corresponding to a key illuminated for a performance guide. If there has been no such corresponding key-on event as determined at step S68, the performance progression is temporarily stopped at step S69, after which the process goes to step S73. If there has been such a corresponding key-on event as determined at step S68, the performance is caused to progress at step S70. If there is any data on which a guide operation is to be performed at the current timing as determined at step S71, the performance guide data is executed (e.g., corresponding guide lamp is turned on), after which the process goes to step S73.

At step S73, a determination is made as to whether there has been any input by operation of a manual performance operator (i.e., manual performance input) on the performance operation section 5*a*. If there has been no manual performance input as determined at step S73, the process returns to the main processing routine. If, on the other hand, there has been a manual performance input, a performance signal corresponding to a key-on event is generated through operations at steps S74 and S75, or generation of a performance signal corresponding to a key-off event is stopped, or another operation corresponding to another instruction is performed. After that, the process returns to the main processing routine. For example, the other operation is an operation for stretching the duration of a generated tone if the manual performance input is by operation of a sustain pedal, or an operation for effecting a modulation if the manual performance input is by operation of a modulation wheel.

Server A or server B shown in FIG. 3 supplies a user (of the electronic musical instrument 10) with automatic performance data, registration data prepared per music piece, mode setting data for remotely setting the electronic musical instrument 10, performance training data including performance techniques, etc. in accordance with a desire of the user. These servers perform a communication process in accordance with an operational flow of FIG. 7. Basically, the external equipment 100 too performs a process similar to that performed by the servers.

First, at step S81, an initialization process is performed. At next step S82, a connection request made, for example, in the information of the IC tag 20 is received from the user's electronic musical instrument 10 via the Internet 120. If a connection request has been received as determined at step S83, a user evaluation operation is performed. If the user's connection request is not allowable, the connection is terminated compulsorily. If the user's connection request is allowable, data are prepared and transmitted at step S86.

Namely, the equipment setting information of the IC tag 20*a* contains, in addition to an "URL" and "musical number identification information", a command for causing the electronic musical instrument 10 to transmit "content of a request" and "unique number of the electronic musical instrument". In response to the command, the electronic musical instrument 10 connects to the server. The user evaluation operation is intended to determine whether the data transmitted from the electronic musical instrument 10 is proper or not. If the connection is a new connection (i.e., the user of the electronic musical instrument 10 is a new user), the server may prompt the user to make user registration, in which case information necessary for the user registration operation may be displayed on the display screen 10*e* (display 6).

If the information of the IC tag 20*a* has been falsified, the user of the electronic musical instrument 10 has committed an injustice, etc., then the server judges it better to not transmit the requested data and determines that the connection with the electronic musical instrument 10 is non-allowable. If the server does have the requested data (because the requested data are too old and have been deleted or not stored in the server from the beginning), the connection with the electronic musical instrument 10 is determined to be non-allowable. The electronic musical instrument 10 of the user is arranged to automatically store various data, received from any of the servers, into the internal storage device of the storage section 11 or temporarily store the received data into the RAM 3; this is because some restrictions are sometimes put on the data storage.

As described above, the IC tag 20*a* is embedded in the performance-related information object, such as a music paper 20 (or lyric sheet or the like), and the electronic musical instrument 10 reads the identification code etc. of the music piece from the IC tag 20*a*. If the electronic musical instrument 10 has the automatic performance data set of the identification code stored therein, the automatic performance data set is automatically set in the musical instrument 10. If, on the other hand, the electronic musical instrument 10 does not have the automatic performance data set of the identification code stored therein, it can acquire the automatic performance data set through the Internet. Therefore, setting of a desired automatic performance data set can be performed with an extreme ease. The thus-set automatic performance data can be used not only for reproduction of the music piece, but also for a training performance to provide a performance guide.

The electronic musical instrument 10 also reads out, from the IC tag 20*a*, various equipment setting data, such as tone color parameters, parameters of various effects like a reverberation effect and panning, and registration data and sets therein the read-out data; thus, the electronic musical instrument 10 can be placed in settings suitable for a performance of the music piece of the music paper 20, with an extreme ease.

Further, because the electronic musical instrument 10 can acquire, from the IC tag 20*a*, the URL of a server that supplies various data pertaining to the music piece of the music paper 20, connection to a related homepage of the necessary server is facilitated. Further, because the electronic musical instrument 10 can automatically connect to the server with the URL, it can acquire various data from the related homepage and display the acquired data on the display screen; for example, the electronic musical instrument 10 acquires and displays performance technique information on the display screen. In this way, there can be achieved a training performance that teaches how to perform the music piece.

Further, each time the user turns the pages of the music paper 20, an automatic performance or training performance can be automatically set to a performance position (reproduction position) corresponding to the musical score 20*b* of the new (newly-opened) page; thus, the automatic performance or training performance (performance guide) can be adjusted to the newly-opened page of the music paper 20, so that the automatic performance or training can be executed smoothly.

Whereas, in the above-described embodiment, the reading operation by the IC tag read section 15 is started in response to the music paper 20 being detected by the read trigger sensor 14, the start of the reading operation may alternatively be triggered, for example, by operation of a particular switch on the setting operation section 5*b*. In another alternative, the reading operation by the IC tag read section 15 may be triggered by powering-on of the electronic musical instrument 10 and then performed constantly.

Further, whereas the embodiment has been described in relation to the case where the music-piece-related information object is a music paper, the music-piece-related information object may be a lyric sheet or book, in which case the music-piece-related information is lyrics. Further, the aforementioned performance position data of automatic performance data (or karaoke music piece) is prestored in an IC tag provided in a lyric sheet and corresponds to the head position of the lyrics of the lyric sheet, and the automatic performance starts to be reproduced at a position corresponding to the start point of the lyrics.

Further, whereas the music paper 20 in the above-described embodiment has been described as comprising a plurality of double-page spreads, it may be in the form of a single sheet of music or single lyric card. Although, in the above-described embodiment, each double-page spread comprises a pair of left and right pages having a musical score 20*b* printed thereon, a musical score may be printed on only one of the two pages. Namely, the terms "double-page spread" are used herein to merely mean a surface of the music paper the human operator sees when the operator has turned the pages; the terms should never be interpreted as limited to a surface having a musical score or lyrics printed across a pair of left and right pages.

Furthermore, the embodiment has been described in relation to the case where the RFID system has the "anti-collision (collision prevention)" function. However, in a case where the RFID system does not have the "anti-collision (collision prevention)" function, the IC tag read section 15 may read the information of the IC tag 20*a* only in the top or uppermost page with a magnetic shield plate positioned on the reverse surface of the IC tag 20*a*. Further, the RFID system may be of any suitable type than the electromagnetic induction type.

Furthermore, whereas the embodiment has been described in relation to an electronic keyboard instrument, the present invention may be applied to other types of electronic musical instruments as long as the user can execute a music performance on the performance operation section.

What is claimed is:

1. An electronic musical instrument system comprising:

a music-piece-related information object having music-piece-related information of a given music piece presented thereon, said music-piece-related information object also having attached thereto an RF tag that has stored therein equipment setting information related to a performance, by an electronic musical instrument, of the given music piece; and an electronic musical instrument having a performance operation section operable by a user to execute a performance, said electronic musical instrument further comprising:

an information acquisition information that communicates with the RF tag to acquire the equipment setting information from the RF tag; and an automatic setting section that automatically sets various settings and states of the electronic musical instrument in accordance with the equipment setting information acquired by said information acquisition information.

2. An electronic musical instrument system as claimed in claim 1 wherein the music-piece-related information object is a printed material having at least one of a musical score and lyrics of the given music piece visibly printed thereon.

3. An electronic musical instrument system as claimed in claim 1 wherein said electronic musical instrument includes a storage section having automatic performance data of a plurality of music pieces stored therein, the equipment setting information includes musical number identification information indicative of a name of the given music piece presented on the music-piece-related information object, and said automatic setting section extracts the musical number identification information from the equipment setting information acquired from the RF tag, searches said storage section to search out automatic performance data of the given music piece on the basis of the extracted musical number identification information, reads out the searched-out automatic performance data from said storage section, and performs setting such that said electronic musical instrument executes an automatic performance based on the read-out automatic performance data.

4. An electronic musical instrument system as claimed in claim 3 wherein the RF tag further has stored therein URL information of a server that supplies the automatic performance data of the given music piece, and wherein, when the automatic performance data of the given music piece could not be searched out from said storage section on the basis of the extracted musical number identification information, said automatic setting section reads out the URL information from the RF tag, acquires, from a server on a network, the automatic performance data corresponding to the extracted musical number identification information, and performs setting such that said electronic musical instrument executes an automatic performance based on the acquired automatic performance data.

5. An electronic musical instrument system as claimed in claim 1 wherein the equipment setting information includes function setting data for setting various functions of an electronic musical instrument related to a performance of the given music piece, and said automatic setting section of the electronic musical instrument extracts function setting data from the equipment setting information acquired from the RF tag, and sets the various functions of the electronic musical instrument on the basis of the extracted function setting data.

6. An electronic musical instrument system as claimed in claim 5 wherein the function setting data includes data for setting tone characteristics, such as a tone color and effect.

7. An electronic musical instrument system as claimed in claim 6 wherein said automatic setting section reads said data for setting tone characteristics, such as a tone color and effect, and generates parameters for setting tone characteristics, such as a tone color and effect, of a tone to be generated by said electronic musical instrument.

8. An electronic musical instrument system as claimed in claim 3 wherein, when the automatic performance data of the given music piece could not be searched out from said storage section on the basis of the extracted musical number identification information, said automatic setting section identifies automatic performance data similar to the automatic performance data indicated by the musical number identification information, reads out the identified similar automatic performance data from said storage section, and performs setting such that said electronic musical instrument executes an automatic performance based on the read-out automatic performance data.

9. An electronic musical instrument system as claimed in claim 5 wherein, when said electronic musical instrument can not be set to a function indicated by the extracted function setting data, said automatic setting section sets said electronic musical instrument to a function similar to the function indicated by the extracted function setting data.

10. An electronic musical instrument system as claimed in claim 5 wherein said automatic setting section sets said electronic musical instrument to functions suitable for said electronic musical instrument, by reading the function setting data.

11. An electronic musical instrument system as claimed in claim 5 wherein the RF tag further has stored therein URL information of a server that supplies performance technique information related to the given music piece, said electronic musical instrument includes a display device, and said automatic setting section reads out the URL information from the RF tag, acquires, from a server on a network, the performance technique information, and displays the acquired performance technique information on said display device.

12. An electronic musical instrument system as claimed in claim 1 wherein the equipment setting information includes performance position data indicative of a particular performance position in the given music piece, and said automatic setting section sets, in accordance with the performance position data included in the acquired equipment setting information, an automatic performance position or performance guide position of the given music piece to be performed by said electronic musical instrument.

13. An electronic musical instrument system as claimed in claim 12 wherein, when new equipment setting information has been acquired during a course of an automatic performance or performance guide of the given music piece, and once the automatic performance or performance guide progresses to a predetermined breakpoint, said automatic setting section updates, in accordance with the performance position data included in the acquired equipment setting information, an automatic performance position or performance guide position of the given music piece to be performed by said electronic musical instrument and sets the updated automatic performance position or performance guide position.

14. An electronic musical instrument system as claimed in claim 1 wherein the music-piece-related information object includes a plurality of the RF tags, and said information acquisition section communicates with one of the RF tags to acquire the equipment setting information from the one RF tag.

15. An electronic musical instrument system as claimed in claim 14 wherein the music-piece-related information object is in a form of a book comprising a plurality of pages, and each of the RF tags is provided on a different one of the pages, and said information acquisition section communicates with the RF tag in a currently-opened page of the music-piece-related information object.

16. An electronic musical instrument system as claimed in claim 1 wherein said electronic musical instrument further comprises a trigger section that triggers said information acquisition section to acquire the equipment setting information from the RF tag, and when said information acquisition section has acquired new equipment setting information in response to triggering by the trigger section, said automatic setting section sets states of said electronic musical instrument in accordance with the acquired new equipment setting information.

17. An electronic musical instrument system as claimed in claim 16 wherein the music-piece-related information object comprises a plurality of double-page spreads with the RF tag provided on each of the double-page spreads, each of the RF tags having stored therein equipment setting information related to a progression of a music piece on a corresponding one of the double-page spreads, and said trigger section of said electronic musical instrument detects updating of the double-page spread of the RF tag and triggers said information acquisition section to acquire the equipment setting information from the RF tag in the updated double-page spread.

18. An electronic musical instrument system as claimed in claim 16 wherein the equipment setting information includes performance position data indicative of a particular performance position in the given music piece, and wherein, when said information acquisition section has acquired new equipment setting information in response to triggering by said trigger section, said automatic setting section sets, in accordance with the performance position data included in the acquired new equipment setting information, an automatic performance position or performance guide position of the given music piece to be performed by said electronic musical instrument.

19. An electronic musical instrument system as claimed in claim 18 wherein said electronic musical instrument has a function for executing an automatic performance on the basis of automatic performance data, and wherein, when the new equipment setting information has been acquired during a course of an automatic performance or performance guide based on the automatic performance data, and once the automatic performance or performance guide progresses to a predetermined breakpoint, said automatic setting section updates, in accordance with the performance position data included in the new equipment setting information, the automatic performance position or performance guide position of the given music piece to be performed by said electronic musical instrument and sets the updated automatic performance position or performance guide position.

20. An electronic musical instrument system as claimed in claim 19 which is a training electronic musical instrument system, and wherein said electronic musical instrument is an electronic musical instrument for a trainee, and the automatic performance or performance guide based on the automatic performance data is for a training purpose.

21. An electronic musical instrument system as claimed in claim 16 wherein the equipment setting information includes function setting data for setting various functions in relation to a performance position in the given music piece, and wherein, when said information acquisition section has acquired new equipment setting information in response to triggering by said trigger section, said automatic setting section sets, in accordance with the function setting data included in the acquired new equipment setting information, various functions of the electronic musical instrument in relation to the performance position.

22. An electronic musical instrument system as claimed in claim 17 wherein said electronic musical instrument includes a display device, and the equipment setting information includes musical score data of the given music piece, and wherein, when said information acquisition section has acquired new equipment setting information in response to triggering by said trigger section, said automatic setting section displays, on the display device, a musical score corresponding to the updated double-page spread on the basis of the musical score data included in the acquired new equipment setting information.

23. An electronic musical instrument system as claimed in claim 16 wherein said trigger section includes a sensor that detects that the music-piece-related information object has been set in or on a predetermined position of said electronic musical instrument.

24. An electronic musical instrument system as claimed in claim 16 wherein said trigger section includes a switch and instructs, on the basis of an output of the switch, said information acquisition section to acquire the equipment setting information from the RF tag.

25. A computer-readable storage medium containing a group of instructions for causing a computer, provided in an electronic musical instrument system, to execute a setting program, the electronic musical instrument system comprising: a music-piece-related information object having music-piece-related information of a given music piece presented thereon, the music-piece-related information object also having attached thereto an RF tag that has stored therein equipment setting information related to a performance, by an electronic musical instrument, of the given music piece; and an electronic musical instrument having a performance operation section operable by a user to execute a performance, said setting program comprising:

an acquisition step of communicating with the RF tag to acquire the equipment setting information from the RF tag; and a setting step of said electronic musical instrument automatically setting various settings and states of the musical instrument in accordance with the equipment setting information acquired by said acquisition step.

26. A computer-readable storage medium as claimed in claim 25 wherein said setting program further comprises a step of triggering said electronic musical instrument to acquire the equipment setting information from the RF tag, and wherein, when said electronic musical instrument has acquired new equipment setting information in response to triggering by said step of triggering, said setting step sets states of said electronic musical instrument in accordance with the acquired new equipment setting information.

* * * * *